United States Patent [19]

Kokjohn et al.

[11] 3,943,333

[45] Mar. 9, 1976

[54] OPEN COIL ELECTRIC HEATING ELEMENTS

[76] Inventors: Leonard D. Kokjohn, 4238 Harrison, Rockford, Ill. 61111; Wayne R. Seeley, 505 Hortense, Kirkland, Ill. 60146; Charles A. Brown, 5548 Springbrook Road, Rockford, Ill. 61111; Reynold C. King, 854 N. 18th St., Wytheville, Va. 24382

[22] Filed: Aug. 23, 1974

[21] Appl. No.: 500,134

[52] U.S. Cl. ..... 219/532; 174/138 J; 219/536; 338/318

[51] Int. Cl.[2] ..... H05B 3/06

[58] Field of Search ..... 219/376, 408, 532, 536, 219/537, 552; 338/244, 245, 257, 268, 262, 317, 318, 319; 174/50, 53 R, 53, 138 J

[56] References Cited

UNITED STATES PATENTS

| | | | |
|---|---|---|---|
| 948,819 | 2/1910 | Lutz | 174/50 X |
| 2,397,568 | 4/1946 | Seaman | 338/245 |
| 2,457,598 | 12/1948 | Osterheld | 219/536 |
| 2,628,300 | 2/1953 | Berkelhamer | 338/257 |
| 2,665,357 | 1/1954 | DuBois | 338/319 X |
| 2,921,172 | 1/1960 | Hackman | 219/532 |
| 3,205,467 | 9/1965 | Ganci | 338/268 |

*Primary Examiner*—Volodymyra Y. Mayewsky

[57] ABSTRACT

Our invention relates to open coil electric heating elements of conventional construction but treated to resist corrosion and to electrically insulate exposed metallic surfaces. In accordance with the invention, the component parts of the heater, except the coiled resistance wire and in some cases the supporting insulating bushings, are assembled and then coated with a silicone resin-based coating composition. The composition is applied in a flowable state to cover all exposed surfaces and fill all cracks and crevices to thereby prevent accumulation of moisture thereat.

2 Claims, 8 Drawing Figures

OPEN COIL ELECTRIC HEATING ELEMENTS

BACKGROUND AND SUMMARY

Open coil electric heating elements are well known in the art and are produced in many forms for various uses. This type of heating element may be disposed in ducts for heating air flowing therethrough; or may be used as a dryer element for clothes dryers; or as a heater for dishwashers; as well as for many other uses.

Because of cost limitations, many metal parts of the heater have been formed of ordinary mild steel which is subject to corrosion in some of the moist environments where the heater is used. Heretofore, to avoid corrosion, some of the metal parts have been formed from galvanized steel strip, but this protection is not only costly but does not entirely avoid corrosion because the strip must be cut, formed and punched, which therefore exposes unprotected edges.

Further, in view of the great amount of attention now being concentrated on consumer safety, it is important that the metal frame is of an electrical insulated nature to avoid dangerous shortcircuits in the event a heating coil should break and a portion thereof touch the frame structure. However, because of the high heat generated by open coil electric heaters, it is not practical to form the frame structure of plastic, rubber, or other insulating materials.

Our invention retains the low-cost feature of forming the heater frame structure of mild steel, without the additional cost of galvanizing, and retains the strength and heat resistance of metal, yet provides corrosion resistance and electrical insulating qualities to such frame structure. In accordance with one aspect of our invention, the metal heater parts are fully assembled with the insulator bushings fixed in position, and this assembly is coated with a silicone resin-based coating composition, and thereafter the coiled resistor is threaded through the bushings and final electrical connection to the terminals is made. In another aspect of our invention, the coating is applied to the assembled metal parts of the frame structure, and then the bushings are fixed in position and the resistor threaded therethrough.

DESCRIPTION OF THE DRAWINGS

In the drawings accompanying this specification and forming a part of this application there are shown, for purpose of illustration, embodiments which our invention may assume, and in these drawings.

DESCRIPTION OF THE PREFERRED EMBODIMENT

Figure 1:
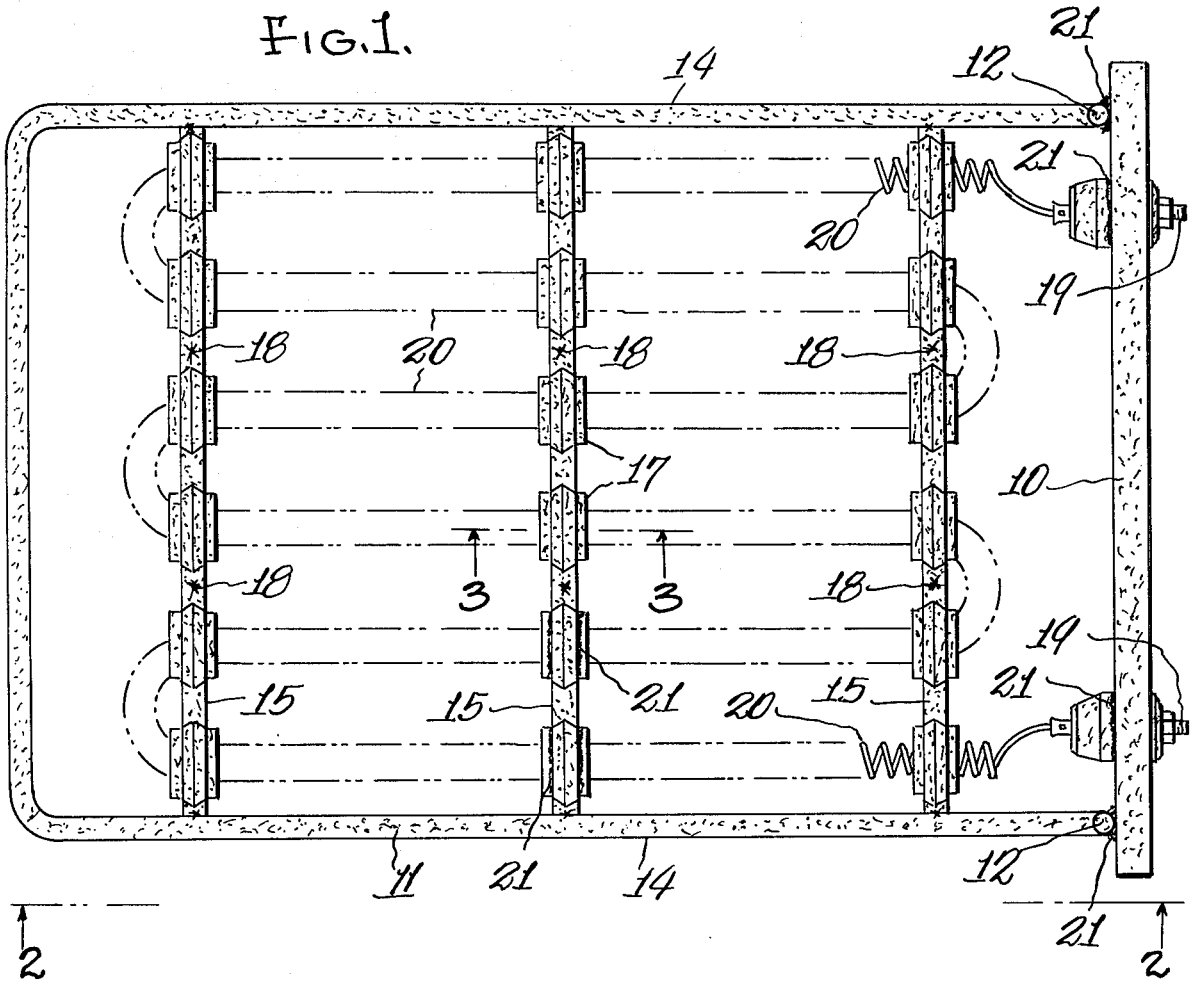
FIG. 1 is a plan view of one type of open coil electric heater, showing our invention applied thereto.
Figure 4:
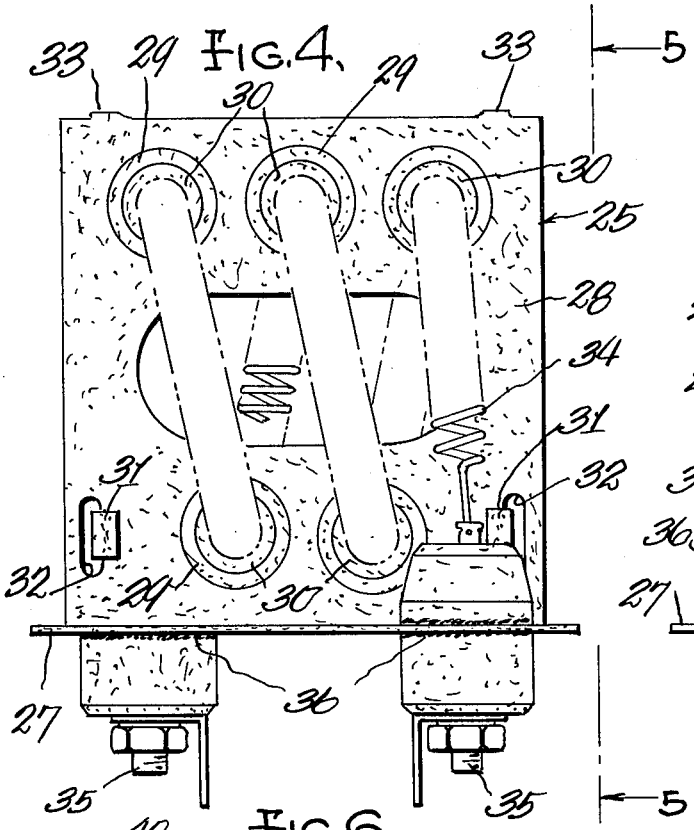
FIG. 4 is a plan view of another type of heater, showing our invention applied thereto.
Figure 6:
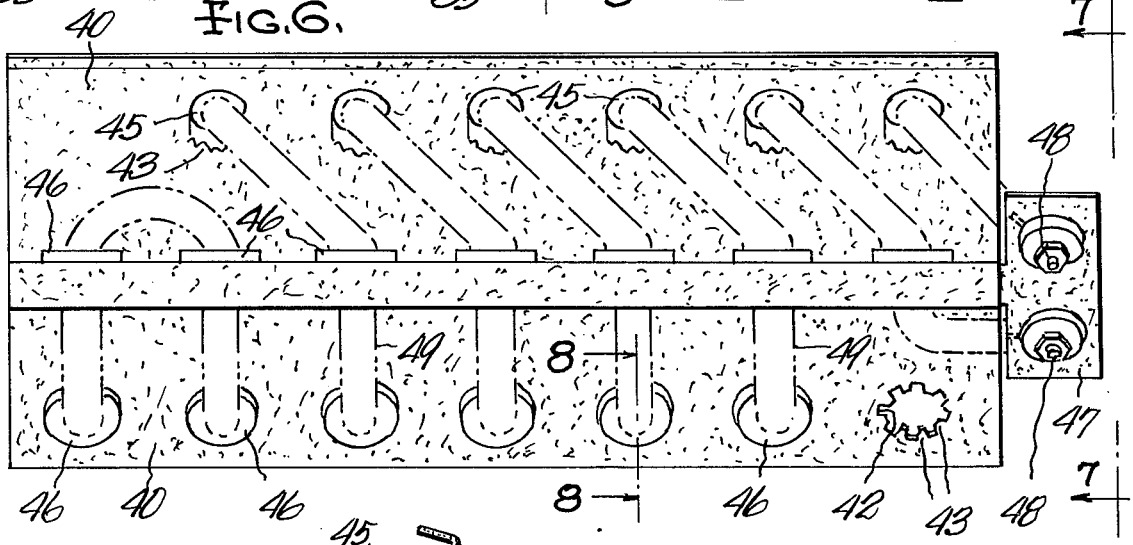
FIG. 6 is a plan view of another type of heater, showing our invention applied thereto.

The structures shown in FIGS. 1, 4 and 6 are illustrative of the type of open coil electric heaters to which our invention may be applied, but it should be understood that the types shown in the drawings are illustrative only, and that the invention may be applied to other forms of open coil electric heaters.

Figure 2:
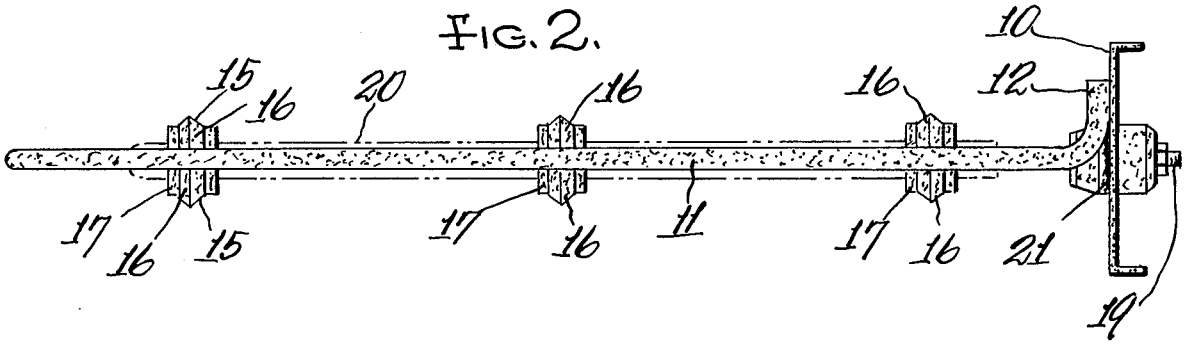
FIG. 2 is a side view corresponding to the line 2—2 of FIG. 1.
Figure 3:
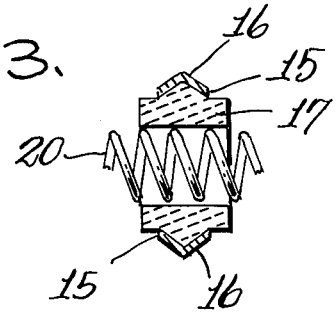
FIG. 3 is an enlarged, fragmentary sectional view corresponding to the line 3—3 of FIG. 1.
Figure 5:
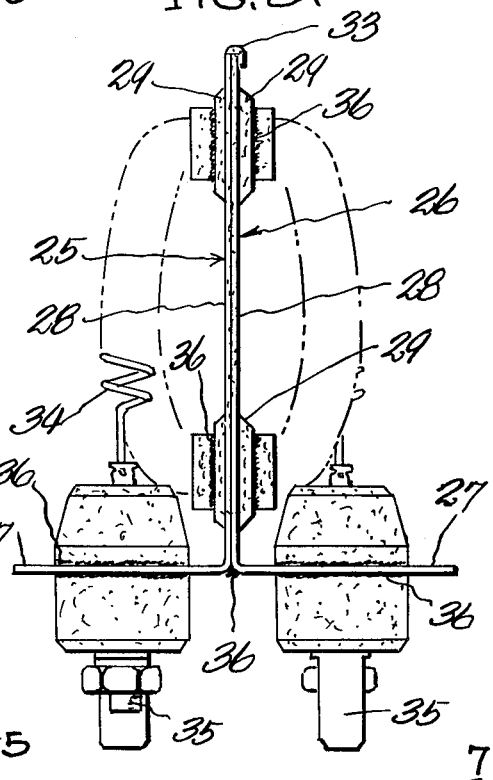
FIG. 5 is a side view corresponding to the line 5—5 of FIG. 4.
Figure 7:
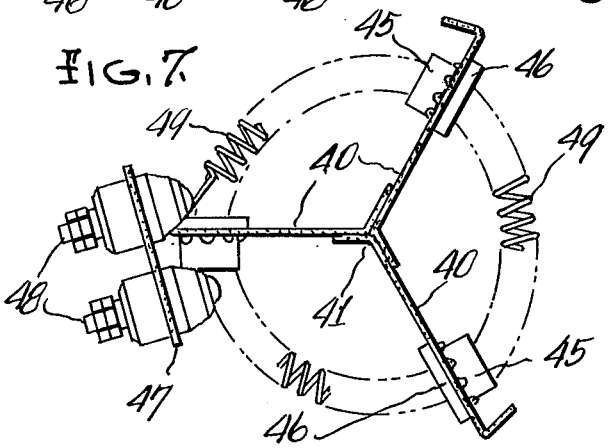
FIG. 7 is a side view corresponding to the line 7—7 of FIG. 6.
Figure 8:
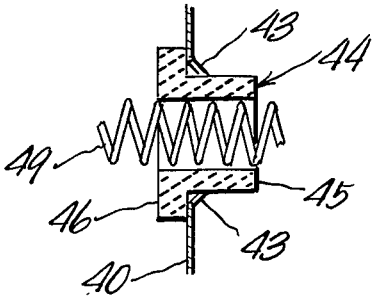
FIG. 8 is an enlarged, fragmentary sectional view corresponding to the line 8—8 of FIG. 6.

The heater shown in FIGS. 1 through 3 is commonly installed within a duct for heating air flowing therethrough, for use in a space heating installations, for example. The heater shown in FIGS. 4 and 5 is commonly used in a dishwasher for heating during the drying cycle. The heater shown in FIGS. 6 through 8 is commonly used in a clothes dryer for heating air circulated through the clothes contained in the dryer.

The foregoing heaters, and others of the open coil type, have many things in common, such as a fabricated steel frame structure, terminals and insulator bushings carried by the frame structure, and a helically coiled resistance wire threaded through the insulator bushings in a predetermined pattern and electrically connected to the terminals.

In FIGS. 1 through 3, the frame structure comprises a metal channel 10 which is adapted to support the heater within a duct (not shown). A U-shaped metal rod 11 has its ends 12—12 welded to the channel to form a rigid structure. Extending crosswise of the legs 14—14 of the rod 11 are a plurality of paired, metal straps 15—15. The straps have paired sockets 16—16 which combine to receive an insulator bushing 17 and lock it in place when the paired strips are connected together, such as by spot welding 18. The ends of the paired strips are welded or brazed to the rod legs 14—14. Terminals 19—19 are supported by the channel 10 in insulated manner, and are adapted to be connected to a source of electrical energy. Threaded through the bushings 17 is a helically coiled resistance wire 20, the opposite ends of which are electrically connected to respective terminals 19,19. The foregoing structure may be similar to that shown in U.S. Pat. No. 2,921,172, issued Jan. 12, 1960, to Amos W. Hackman.

In carrying out our invention, the metal frame structure is fully fabricated and assembled with the insulators 17 locked in place by the connected paired strips 15—15. Before the resistor wire 20 is strung through the bushings 17, the assembly is coated with a silicone resin-based coating composition which may be of a suitable type commercially available. A coating composition found suitable for the purpose is manufactured by the Midland Division of The Dextor Corporation, and is sold under the designation 11X929. The coating, prior to application to the frame structure is in liquid flowable form, and may be applied by dipping, spraying or brushing, to provide a relatively uniform coating, as indicated by the stippling in the drawings, with care taken in the case of spraying or brushing, that all cracks and crevices are filled with the coating. A coating of about 2 mils thick has been found suitable. Any suitable compatible pigment may be added to the coating composition to provide a desired color. The coating may be air-dried, but in the interest of manufacturing efficiency, the coated frame structure is baked in a furnace for about 10 to 30 minutes at about 600° F.

When dry, the coating provides a smooth surface with all cracks and crevices thoroughly sealed, as suggested by the reference numeral 21 at various places in FIGS. 1 through 3, to prevent accumulation of moisture at such places.

The helically coiled resistor wire 20 is then strung through the various insulator bushings 17, and the opposite ends of the wire are mechanically and electrically connected to the terminals 19—19. The connection may be effected by disposing an end of the resistor wire within an opening in the inner end of the respective terminal and such end crimped over the wire. In such case, the terminals and their insulated bushings may be assembled with the supporting frame and therefore are also coated, as shown. The threaded parts of the terminals are preferably protected against coating. The final assembly provides an open coil electric heater wherein all metal parts of the frame structure are coated to resist corrosion. Likewise, since the coating has electrical insulating qualities, the frame structure is adequately insulated against short circuits, such as may develop if a current supply wire is accidentally contacted with the frame structure or if the resistor for any reason should break and a portion thereof contact the frame structure.

The dishwasher element shown in FIGS. 4 and 5 comprises a pair of metal plates 25 and 26, each having a generally flat base 27 and an angularly related leg 28. The legs have a series of matching pockets 29 within which the annular intermediate flange of an insulator bushing 30 is confined. The legs 28 are held in flatwise connected relation by tabs 31 struck out from one leg and passing through openings 32 in the other leg, the ends of the tabs being clinched over the outwardly facing surface of such other leg. Other tabs 33, on one leg may be clinched over a marginal surface of the other leg.

As before, a coating of a silicone resin-based coating composition is applied to the assembled frame structure, and the resistor wire 34 is then strung through the insulator bushings and has its opposite ends mechanically and electrically secured to the terminals 35—35. The coating (shown by stippling in the drawing) as in the case described in connection with FIGS. 1 through 3, provides a corrosion-resistive, electrically-insulating protection to the metal frame parts, and seals all cracks and crevices, as suggested by the reference numeral 36 at various places, to seal out moisture.

The clothes dryer element shown in FIGS. 6 through 8, comprises a frame structure including a plurality of angularly related metal plates 40, spot-welded together at a central location, as seen at 41. Each of the metal plates has a plurality of holes formed therein and arranged in a predetermined pattern. Each hole is shaped as shown at 42 in FIG. 6, and is formed by a punching die wherein the marginal surface defining the hold is serrated to provide a plurality of tongues 43.

The insulator bushings 44 in this case are formed as a tubular body 45 with a head 46 at one end. The body is of a diameter so that it may be pushed into a respective hold until the head 46 engages a surface of a plate 40. This action displaces the tongues from the plane of the plate to an angular relation, as shown in FIG. 8, wherein they firmly grip the insulator body 45 and hold it in position.

In the heater shown in FIGS. 6 through 8, the metal plates 40 are fabricated and welded together, and a terminal plate 47 is welded to one of the plates 40. If the terminals 48—48 are of the type shown in FIGS. 1 through 5, they and their insulating bushings may be connected to the terminal plate. However, if the terminals 48 are of the type shown in FIGS. 6 and 7, wherein the resistor wire is clamped under a head portion of the terminal, they may be omitted at this stage of assembly.

In any event, the entire assembly, less the helically coiled resistor wire 49 and insulator bushings 44, is coated as before. Thereafter, the insulator bushings 44 are pressed into place and the resistor wire is strung therethrough in the pattern shown. The terminals 48—48 and their insulating bushings may then be assembled with the terminal plate 47 and connected to the respective ends of the resistor wire.

We claim:

1. An open coil electric heating element, comprising:

a metal frame support formed of a plurality of metal members which are rigidly connected together, a plurality of insulator bushings carried by said frame support in predetermined spaced manner, a coiled bare resistance wire strung through said insulator bushings and adapted to be connected to a source of electricity to produce heat, and a coating of silicone resin-based coating composition on said frame support, said coating being applied in flowable form to cover all exposed surfaces of said frame support, the coating drying to a rigid state to provide corrosion-resistance and electrical-insulating properties to said metal frame support, said coating filling all cracks and crevises of and between the parts comprising said frame support.

2. The construction according to claim 1 wherein said coating also covers said insulator bushings.

* * * * *